US010519754B2

(12) United States Patent
Prisbell et al.

(10) Patent No.: US 10,519,754 B2
(45) Date of Patent: Dec. 31, 2019

(54) FULLBORE FIRING HEADS INCLUDING ATTACHED EXPLOSIVE AUTOMATIC RELEASE

(71) Applicant: Schlumberger Technology Corporation, Sugar Land, TX (US)

(72) Inventors: Andrew Prisbell, Rosharon, TX (US); Mohamed Mehdi, Houston, TX (US); Christopher Sarvari, Missouri City, TX (US); Indranil Ghosh, Sugar Land, TX (US); Jose Escudero, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 398 days.

(21) Appl. No.: 15/371,608

(22) Filed: Dec. 7, 2016

(65) Prior Publication Data

US 2017/0175499 A1 Jun. 22, 2017

Related U.S. Application Data

(60) Provisional application No. 62/269,080, filed on Dec. 17, 2015.

(51) Int. Cl.

| | |
|---|---|
| ***E21B 43/116*** | (2006.01) |
| ***F42D 1/04*** | (2006.01) |
| ***F42D 1/08*** | (2006.01) |

(52) U.S. Cl.

CPC ..... *E21B 43/116* (2013.01); *F42D 1/08* (2013.01)

(58) Field of Classification Search

CPC .... E21B 17/06; E21B 43/116; E21B 17/1057; E21B 23/04; F42D 1/08

See application file for complete search history.

(56) References Cited

U.S. PATENT DOCUMENTS

| | | | | | |
|---|---|---|---|---|---|
| 4,067,388 | A | * | 1/1978 | Mouret | E21B 23/04 166/208 |
| 4,690,227 | A | * | 9/1987 | George | E21B 43/1185 175/4.54 |
| 5,050,672 | A | * | 9/1991 | Huber | E21B 23/00 166/55 |
| 5,293,940 | A | * | 3/1994 | Hromas | E21B 43/116 166/297 |
| 5,398,760 | A | * | 3/1995 | George | E21B 23/006 166/297 |
| 5,505,261 | A | * | 4/1996 | Huber | E21B 23/04 166/151 |

(Continued)

FOREIGN PATENT DOCUMENTS

CA 1303969 C 6/1992

*Primary Examiner* — Daniel P Stephenson
(74) *Attorney, Agent, or Firm* — Cameron R. Sneddon

(57) ABSTRACT

Embodiments of the present disclosure may provide a perforation tool and method for operating the perforation tool. The perforation tool may include one or more firing heads and one or more gun assemblies. The perforation tool may also include a release mechanism coupled to the one or more firing head and the one or more gun assemblies. The release mechanism may release the one or more gun assemblies to a bottom of a wellbore upon firing of the one or more gun assemblies and maintain the one or more firing heads on the perforation tool.

18 Claims, 8 Drawing Sheets

(56) References Cited

U.S. PATENT DOCUMENTS

| | | | | |
|---|---|---|---|---|
| 5,509,481 | A * | 4/1996 | Huber | E21B 23/04 166/297 |
| 7,353,871 | B2 | 4/2008 | Hromas et al. | |
| 8,807,228 | B2 | 8/2014 | Martin et al. | |
| 8,919,236 | B2 * | 12/2014 | Bell | E21B 43/116 166/297 |
| 2003/0192696 | A1 * | 10/2003 | Myers, Jr. | E21B 17/06 166/297 |
| 2005/0284635 | A1 * | 12/2005 | Neves | E21B 17/06 166/297 |
| 2014/0096670 | A1 * | 4/2014 | Bell | E21B 43/116 89/1.15 |
| 2017/0175499 | A1 * | 6/2017 | Prisbell | E21B 43/116 |

* cited by examiner

FULLBORE FIRING HEADS INCLUDING ATTACHED EXPLOSIVE AUTOMATIC RELEASE

BACKGROUND

It may be desirable to automatically disconnect a tool from a string in a well after completion of a particular operation. Tools exist that may allow for the entire downhole assembly (including perforating guns and firing head system) to be dropped to the bottom of the well. For example, once a perforating gun and firing head system, suspended in a wellbore on a conveyor line (e.g., wireline, tubing, jointed tubing, coiled tubing, or slickline), has been detonated to achieve perforation of a target well zone, it may be desired for the perforating gun to automatically disconnect from the conveyor line. This may be true in permanent completions where no additional conveyor line runs are desired. In these automatic releases, however, the perforating gun and firing heads typically fall to the bottom of the well after detonation and may not be recoverable.

SUMMARY

Embodiments of the present disclosure may provide a perforation tool. The perforation tool may include a firing head and a gun assembly. The perforation tool may also include a release mechanism coupled to the firing head and the gun assembly. The release mechanism may release the gun assembly to a bottom of a wellbore upon firing of the gun assembly and maintain the firing head on the perforation tool.

In an embodiment, the perforation tool may further include a mandrel including a slot on an external surface of the mandrel. The firing head may be positioned in the slot.

In an embodiment, the perforation tool may further include a release housing coupled to the gun assembly. The release mechanism may be positioned within the release housing.

In an embodiment, the perforation tool may further include a first detonation tube coupled to the firing head, and a second detonation tube coupled to the first detonation tube and the gun assembly. The second detonation tube may be released to the bottom of the wellbore with the gun assembly by the release mechanism.

In an embodiment, the second detonation tube may be stabbed into the detonation tube.

In an embodiment, the first detonation tube and the second detonation tube may provide a ballistic path between the firing head and the gun assembly.

In an embodiment, the release mechanism may include a shoulder. The release mechanism may also include a collet finger coupled to the gun assembly and may engage the shoulder. The release mechanism may include a sleeve including a release pin. The release mechanism may include a release piston that may hold the release pin in a locked position against the collet finger to engage the collet finger with the shoulder. The release mechanism may include a break plug coupled to the release piston and may secure the release piston in the locked position.

In an embodiment, the break plug may dislodge upon firing of the gun assembly and cause the release piston to release the release pin.

In an embodiment, the perforation tool may further include an additional filing head. The release mechanism may release the additional filing head to a bottom of a wellbore upon firing of the gun assembly.

Embodiments of the present disclosure may provide a tool for performing perforation operations in a wellbore. The tool may include a mandrel and a firing head coupled to an external surface of the mandrel. The tool may include a release housing coupled to a lower end of the mandrel and a release mechanism housed with the release housing. The tool may also include a gun assembly coupled to the release mechanism. The release mechanism may release the gun assembly to a bottom of a wellbore upon firing of the gun assembly and maintain the firing head on the mandrel.

In an embodiment, the tool may include a delivery system coupled to an upper end of the mandrel. The delivery system may move the mandrel within the wellbore.

In an embodiment, the mandrel may include a slot on the external surface of the mandrel. The firing head may be positioned in the slot.

In an embodiment, the tool may include a first detonation tube coupled to the firing head, and a second detonation tube coupled to the first detonation tube and the gun assembly. The second detonation tube may be released to the bottom of the wellbore with the gun assembly by the release mechanism and the first detonation tube may remain on the perforation tool.

In an embodiment, the second detonation tube may be stabbed into the first detonation tube.

In an embodiment, the first detonation tube and the second detonation tube may provide a ballistic path between the firing head and the gun assembly.

In an embodiment, the release mechanism may include a shoulder and a collet finger coupled to the gun assembly and configured to engage the shoulder. The release mechanism may also include a sleeve that includes a release pin and a release piston that may hold the release pin in a locked position against the collet finger to engage the collet finger with the shoulder. The release mechanism may also include a break plug coupled to the release piston that may secure the release piston in the locked position.

In an embodiment, the break plug may dislodge upon firing of the gun assembly and cause the release piston to release the release pin.

In an embodiment, the tool may include an additional filing head. The release mechanism may release the additional filing head to the bottom of the wellbore upon firing of the gun assembly.

In an embodiment, the tool may include an additional detonation tube coupled to the additional filing head and the gun assembly. The additional detonation tube may provide a ballistic path between the additional firing head and the gun assembly.

Embodiments of the present disclosure may provide a method for performing perforation operations in a wellbore. The method may include positioning a perforation tool in the wellbore. The perforation tool may include a firing head, a gun assembly, and a release mechanism coupled to the firing head and the gun assembly. The method may also include activating the firing head to fire the gun assembly. The release mechanism may release the gun assembly to a bottom of the wellbore upon firing of the gun assembly and maintain the firing head on the perforation tool.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
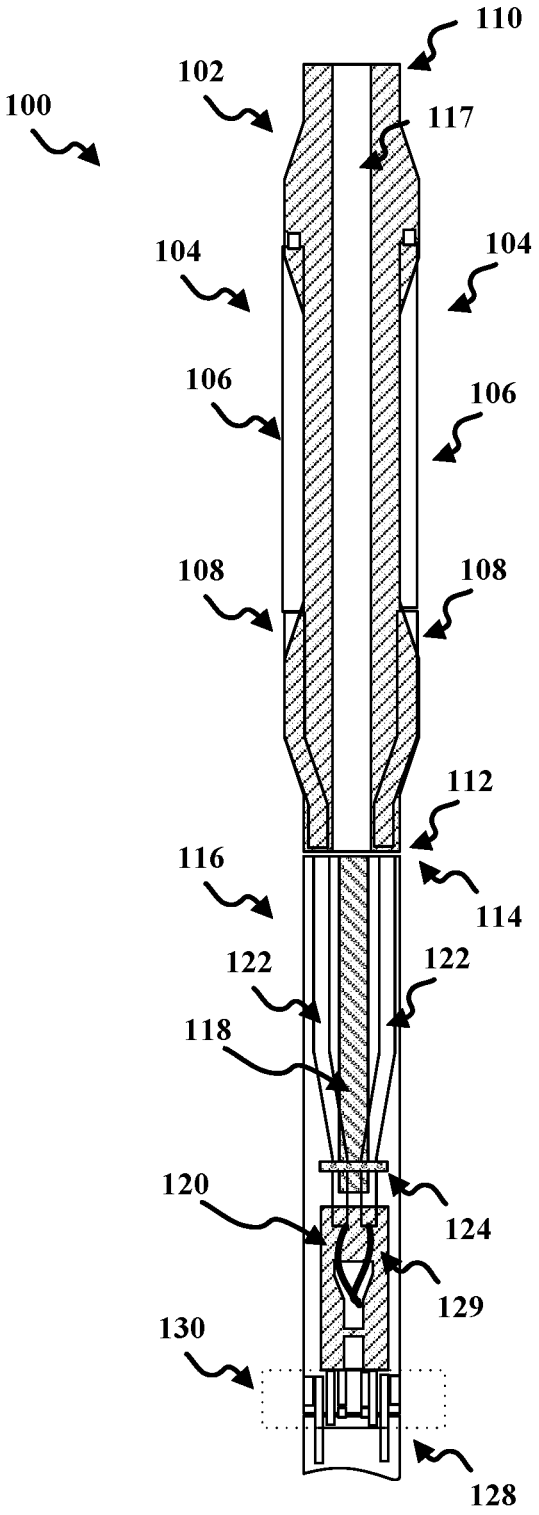
FIG. 1 illustrates an example of perforation tool, according to an embodiment.

Reference will now be made in detail to the various embodiments in the present disclosure, examples of which are illustrated in the accompanying drawings and figures. The embodiments are described below to provide a more complete understanding of the components, processes and apparatuses disclosed herein. Any examples given are intended to be illustrative, and not restrictive. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

Throughout the specification and claims, the following terms take the meanings explicitly associated herein, unless the context clearly dictates otherwise. The phrases "in some embodiments" and "in an embodiment" as used herein do not necessarily refer to the same embodiment(s), though they may. Furthermore, the phrases "in another embodiment" and "in some other embodiments" as used herein do not necessarily refer to a different embodiment, although they may. As described below, various embodiments may be readily combined, without departing from the scope or spirit of the present disclosure.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In the specification, the recitation of "at least one of A, B, and C," includes embodiments containing A, B, or C, multiple examples of A, B, or C, or combinations of A/B, A/C, B/C, A/B/B/BB/C, AB/C, etc. In addition, throughout the specification, the meaning of "a," "an," and "the" include plural references. The meaning of "in" includes "in" and "on."

It will also be understood that, although the terms first, second, etc. may be used herein to describe various elements, these elements should not be limited by these terms. These terms are used to distinguish one element from another. For example, a first object or step could be termed a second object or step, and, similarly, a second object could be termed a first object, without departing from the scope of the invention. The first object and the second object are both objects, but they are not to be considered the same object. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

When referring to any numerical range of values herein, such ranges are understood to include each and every number and/or fraction between the stated range minimum and maximum. For example, a range of 0.5-6% would expressly include intermediate values of 0.6%, 0.7%, and 0.9%, up to and including 5.95%, 5.97%, and 5.99%. The same applies to each other numerical property and/or elemental range set forth herein, unless the context clearly dictates otherwise.

Attention is now directed to processing procedures, methods, techniques, and workflows that are in accordance with some embodiments. Some operations in the processing procedures, methods, techniques, and workflows disclosed herein may be combined and/or the order of some operations may be changed.

In embodiments, a perforation tool may include a firing head system and release mechanism. The firing head system may remain attached to the tubing string after the perforation gun assemblies are fired and subsequently dropped to the bottom of the well. In order to have the firing head attached to the string, the firing heads may be attached to the outside of the tubing. The firing head section may include support features to protect the firing heads from shock. The firing head system may also include one or more ballistic paths for a detonation cord to travel and continue a ballistic connection to the release mechanism below. The ballistic connection may be disconnected at the time of detonation, allowing for the release mechanism, and below perforation gun assemblies, to be dropped to the bottom of the well, while keeping the firing head system attached to the tubing section. In addition to the firing heads that may remain attached to the tubing string, the firing head section may also include other firing heads that may drop along with the below gun string.

FIG. 1 illustrates an example of perforation tool 100, according to an embodiment. In this embodiment, the perforation tool 100 may provide a firing head system that remains attached to the perforation tool 100 after one or more perforation guns are fired and subsequently dropped to the bottom of a wellbore.

As illustrated in FIG. 1, the perforation tool 100 may include a mandrel 102. In embodiments, the mandrel 102 may provide a support platform for securing one or more firing heads of the perforation tool 100 during a run of the perforation tool 100 into a wellbore, and maintain the one or more firing heads after operation of the perforation tool 100. The mandrel 102 may be utilized to retrieve the one or more firing heads from the wellbore upon completion of the operation of the perforation tool 100.

The mandrel 102 may include slots 104 formed within an external surface of the mandrel 102. The slots 104 may house one or more firing heads 106 on the external surface of the mandrel 102. The slots 104 may be formed such that the firing heads 106 are recessed within the body of the mandrel 102 and do not extend beyond an outer diameter of the mandrel 102. For example, a depth, width, and length of the slots 104 may be formed so that the firing heads 106 may be positioned within the slots 104.

The mandrel 102 may include one or more upper detonation tubes ("detotubes") 108. The upper detotubes 108 provide a ballistic path connection between the firing heads 106 and the one or more perforation guns of the perforation tool 100. The firing heads 106 may be coupled to the upper detotubes 108 at a lower portion of the slots 104. For example, lower ends of the firing head 106 may be coupled to upper ends of the upper detotubes 108. The firing heads 106 may be coupled to the upper detotubes 108 by any connector that securely attaches the firing heads 106 to the upper detotubes 108, for example, a threaded connection, collar, sleeve, and the like.

An upper end 110 of the mandrel 102 may include a connector for attaching the mandrel 102 to a delivery system of the perforation tool 100. For example, the upper end 110 may be coupled to a delivery system such as a wireline, tubing, jointed tubing, coiled tubing, slickline, or other sub-assembly for lowering the perforation tool 100 into the wellbore. The upper end 110 of the mandrel 102 may be coupled to the delivery system by any connector that securely attaches the mandrel 102 to the delivery system, for example, a threaded connection, collar, sleeve, and the like. A lower end 112 of the mandrel 102 may be coupled to an upper end 114 of a release housing 116 by a connector. The connector may be any type of connector to securely attach the mandrel 102 to the release housing 116, for example, or example, a threaded connection, collar, sleeve, and the like.

The upper detotubes 108 may be positioned to crossover into the mandrel 102 at a lower portion of the slots 104. The upper detotubes 108 may terminate at the lower end 112 of the mandrel 102. The upper detotubes 108 may be open at the lower end of the upper detotubes 108 to allow lower detotubes to be inserted into the upper detotubes 108. For example, the upper detotubes 108 may be formed to a diameter at the lower end of the detotubes to allow lower detotubes to be inserted into the upper detotubes 108. The open lower ends of the upper detotubes 108 may be accessible at the lower end 112 of the mandrel 102 to receive the lower detotubes housed in the release housing 116.

The firing heads 106 may be any type of firing head that may be mounted on an external surface of the mandrel 102. In some embodiments, for example, the firing heads 106 may be an electronic firing head such as eFire™ Firing Heads manufactured by Schlumberger®. For example, the firing heads 106 may be activated by pressure pulses transmitted through liquid or airfield tubing coupled to the firing heads. The pressure pulse may be transmitted from devices outside the wellbore. In this example, the tubing for communicating with the firing heads 106 may be coupled to an upper end of the firing heads 106 and may be secured to the mandrel 102. When activated by pressure pulse, the firing heads 106 may activate one or more detonators. The one or more detonators may cause a detonation wave within detonation cord housed within the upper detotubes 108.

The mandrel 102 may also include a chamber 117 located within the mandrel 102. The chamber 117 may be formed to travel the length of the mandrel 102 from the upper end 110 to the lower end 112 of the mandrel 102. The chamber 117 may be open at both the upper end 110 and the lower end 112 of the mandrel 102. The chamber 117 may be formed to any shape, for example, a cylindrical shape. The chamber 117 may be utilized to lower one or more tools or devices into the interior of the mandrel 102. In some embodiment, as discussed below, the chamber 117 may be utilized to house one or more secondary firing heads in the perforation tool 100. The one or more secondary firing heads may be utilized as a backup, redundant, or supplementary firing system to the firing heads 106.

The release housing 116 may house a firing support system that provides a ballistic connection between the firing heads 106 and one or more perforation guns, and provides shock protection during activation of the one or more perforation guns. The release housing 116 may also house a release mechanism for releasing the one or more perforation guns and the firing support system after firing of the one or more perforation guns.

As illustrated, the release housing 116 may include a support bar 118 and stacking adapter 120. The support bar 118 may be positioned to support lower detotubes 122. An upper end of the lower detotubes 122 may be configured to be inserted into the upper detotubes 108. For example, when the release housing 116 is coupled to the mandrel 102, the lower detotubes 122 may be stabbed into the upper detotubes 108 to form a connection. The upper ends of the lower detotubes 122 may be formed to a diameter less than a diameter of the open lower ends of the upper detotubes 108. The difference in the diameters may be formed such that a connection may be maintained between the lower detotubes 122 and the upper detotubes 108 prior to the firing of the one or more perforation guns and the connection may be broken once the release mechanism is activated.

The release housing 116 may also include a support ring 124. The support ring 124 in combination with the support bar 118 may support and secure the lower detotubes 122. For example, the support bar 118 and the support ring 124 may be formed to provide shock protection for the upper detotubes 108 and lower detotubes 122 during detonation and perforation. For example, the support ring 124 may be formed to diameter to surround the lower detotubes 122 and apply force to the lower detotubes 122 to secure the lower detotubes 122 against the support bar 118.

The detotubes 108 and lower detotubes 122 may provide a ballistic path from the firing heads 106 to one or more perforation guns in one or more gun assemblies 128. For example, the upper detotubes 108 and lower detotubes 122 may house a detonation cord 129 for igniting charges within the one or more gun assemblies 128. Once one or more detonators in the firing heads 106 are activated, a detonation wave may travel down the detonation cord housed within the upper detotubes 108 and lower detotubes 122 to the stacking adapter 120.

The stacking adapter 120 may provide a ballistic connection between the lower detotubes 122 and the one or more gun assemblies 128. For example, the stacking adapter may include a chamber that joins the detonation cord 129 from the lower detotubes 122. The chamber may be formed to direct the detonation wave into the one or more gun assemblies 128 to activate the one or more perforation guns housed within.

In embodiments, a lower portion 126 of the release housing 116 may be coupled to the one or more gun assemblies 128 by a release mechanism 130. The release mechanism 130 may be configured to activate upon the firing of the one or more perforation guns in the one or more gun assemblies 128. Once the release mechanism 130 activates, the one or more gun assemblies 128 and the lower detotubes 122 may drop to the bottom of the wellbore, while leaving release housing 116, the firing heads 106, and the upper detotubes 108 attached to the mandrel 102.

Figure 2:
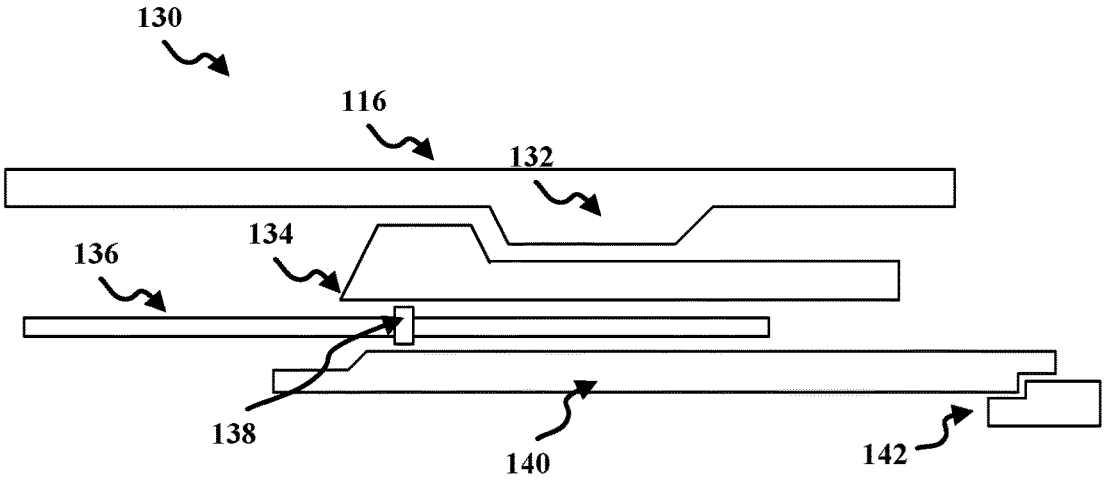
FIG. 2 illustrates an example of the release mechanism, according to an embodiment.

FIG. 2 illustrate an example of a portion the release mechanism 130, according to an embodiment. While FIG. 2 illustrates a portion of the release mechanism, the release mechanism 130 may include multiple combinations of the components discussed below.

As illustrated in FIG. 2, the release mechanism 130 may include an inner shoulder 132. The inner shoulder 132 may be formed on an inner surface of the release housing 116. The release mechanism 130 may also include a collet finger 134. The collet finger 134 may be coupled to the one or more gun assemblies 128. During operation, prior to activating the one or more perforation guns, the collet finger 134 may rest on the inner shoulder 132.

The release mechanism 130 may also include a sleeve 136 with a release pin 138. The sleeve 136 may be coupled to the stacking adapter 120. During operation, prior to activating the one or more perforation guns, the release pin 138 may be positioned to provide force to the collet finger 134 to secure the collet finger 134 against the inner shoulder 132. The release pin 138 may be configured to provide a force sufficient to secure the collet finger 134 against the inner shoulder 132 to support the weight of the one or more gun assemblies 128.

The release mechanism may also include a release piston 140 and a break plug 142. The break plug 142 may be positioned to hold the release piston 140 in a locked position to engage the release pin 138. Prior to activation of the one or more perforation guns, the break plug 142 may hold the release piston 140 in position to force the release pin 138 against the collet finger 134. In this position, the collet finger 134 may be secured against the inner shoulder 132, thereby attaching the one or more gun assemblies 128 to the release housing 116. In this position, the release piston 140 may not move downwardly because the break plug 142 rigidly positions the release piston 140 in place by abutting against the bottom of release piston 140, on one end, and one or more components of the one or more gun assemblies 128, on the other end. The downward pressure force induced on the release piston 140 may induce a downward compressive force on the break plug 142. The break plug 142 may be designed to be stronger than any compressive force that can be induced by the release piston 140. For example, in some embodiments, the break plug 142 may be formed of any frangible material such as ductile iron, cast iron, ceramic, and the like. Upon activation of the one or more perforation guns, the break plug 142 may break or shatter due to the denotation wave.

Figure 3A:
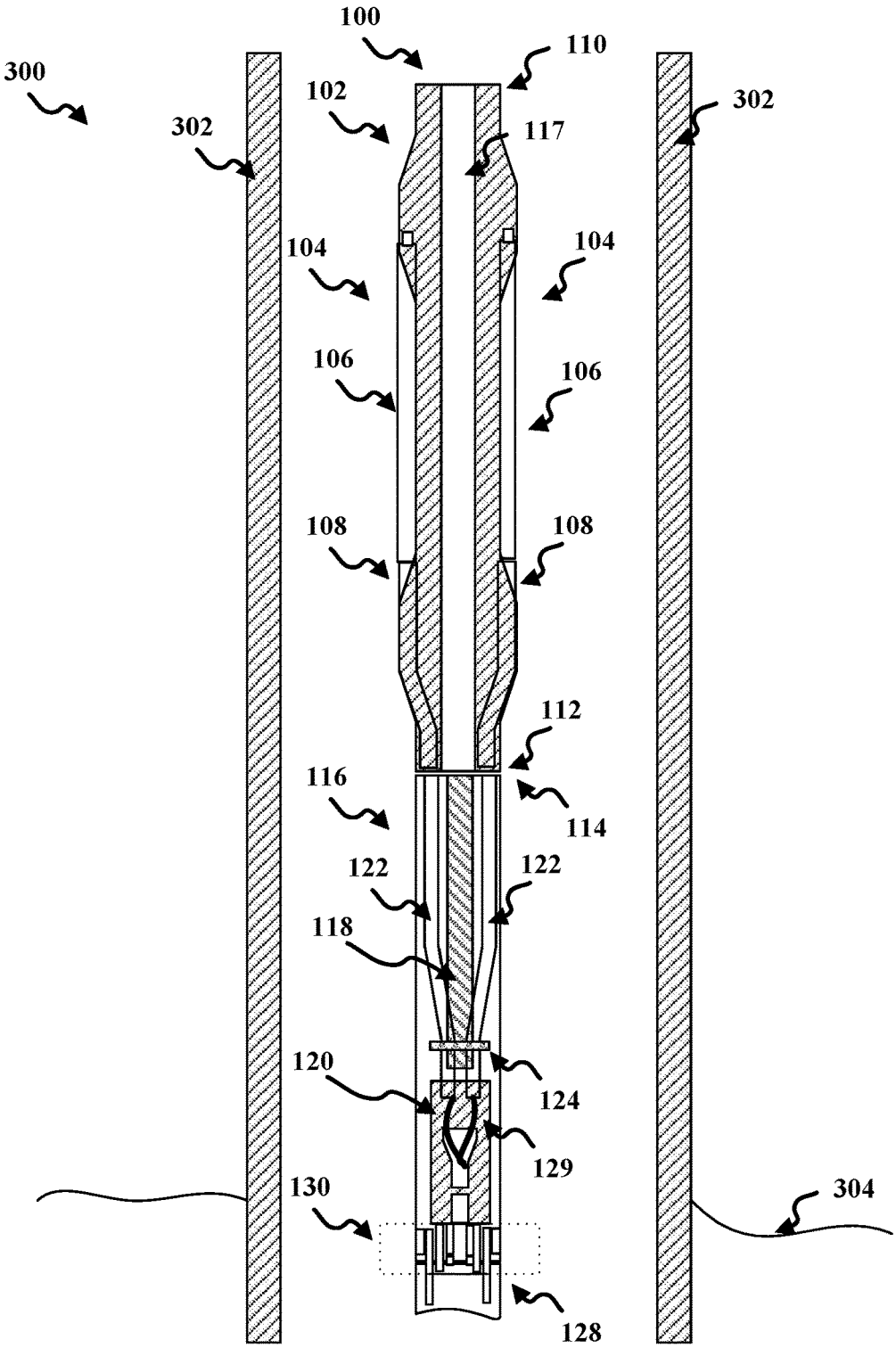
FIGS. 3A-3C illustrates an example of the operation of the perforation tool and the release mechanism, according to an embodiment.
Figure 3B:
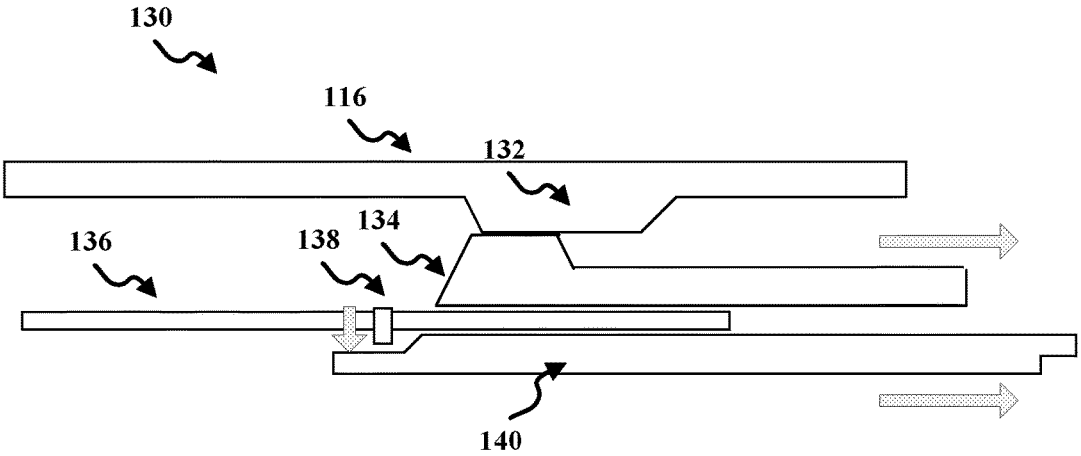
Figure 3C:
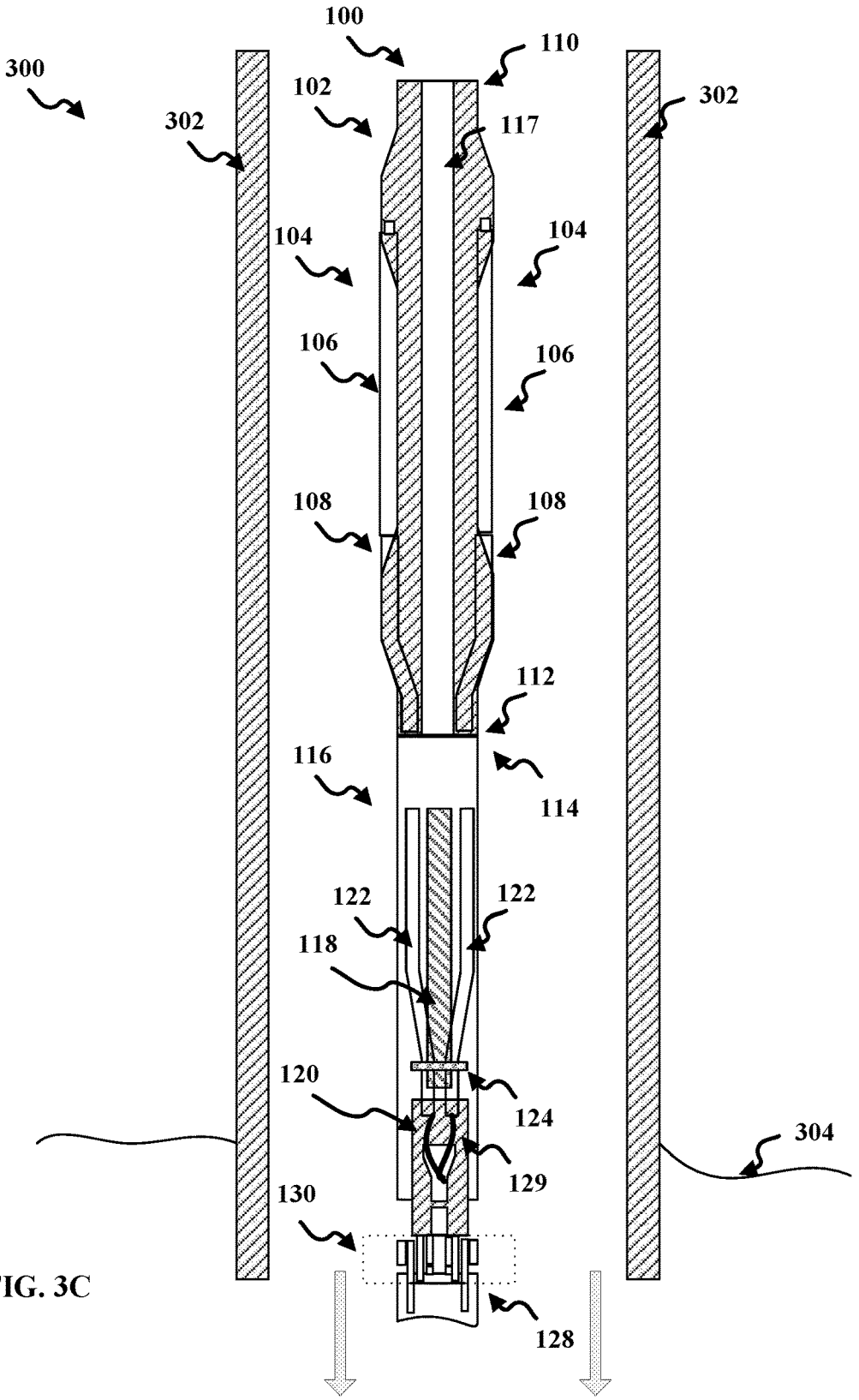

FIGS. 3A-3C illustrates an example of the operation of the perforation tool and the release mechanism, according to an embodiment. As illustrated in FIG. 3A, the perforation tool 100 may be lowered into a wellbore 300 including a casing 302. The perforation tool 100 may be lowered into the wellbore 300 to target perforating depth which corresponds to a desired location of perforation in the casing 302. For example, the perforation tool 100 may be lowered and positioned so that the one or more gun assemblies 128 correspond to a formation 304. Other perforating accessories, such as a packer, may be placed above the perforation tool 100 in the wellbore 300.

Once the perforation tool 100 is positioned, the firing head 106 may be activated to generate a detonation wave in the detonation cord 129. The detonation wave may travel down the upper detotubes 108 and 122 to the stacking adapter 120. The stacking adapter 120 may direct the detonation wave into the one or more gun assemblies 128 to fire the one or more perforation guns. The detention wave may also activate the release mechanism 130.

As illustrated in FIG. 3B, once the detonation occurs, the break plug 142 may be shattered. For example, the resultant shock wave and pressure from the detonation wave shatters the break plug 142, which is made of a frangible material that shatters into small pieces in response to the shock wave from the detonation cord 129. Once the break plug 142 shatters, the release piston 140 may no longer be supported and held in position by the break plug 142. As a result, the release piston 140 may move down. For example, pressure force and/or gravity pushing down on the release piston 140 may force the release piston 140 down into an air chamber below the release piston 140.

By moving down, the release pin 138 may be released. As the release piston 140 moves and disengages with the release pin 138, the release pin 138 may slide within the sleeve 136. Once the release pin 138 may move freely, the release pin 138 may no longer provide force to hold the collet finger 134 against the inner shoulder 132 of the release housing 116. Then, the weight of the one or more gun assemblies 128 may pull the collet finger 134 down below the inner shoulder 132 of the release housing 116. The one or more gun assemblies 128 may then drop to the bottom of the wellbore 300. The lower detotubes 122, which were stabbed into the upper detotubes 108, may disconnect and drop to the bottom of the wellbore 300 with the one or more gun assemblies 128. The release housing 116 and remaining parts above it may remain attached and may not drop to the bottom of the wellbore 300, as illustrated in FIG. 3C. The perforation tool 100, including the firing heads 106 and the release housing 116, may then be removed from the wellbore 300. This allows the perforation tool 100 (or the firing head 106) to be reused in new perforating operations.

In embodiments, the perforation tool 100 may include one or more additional firing heads to supplement the firing heads 106. The additional firing heads may function as a backup or supplement to the firing heads 106. The additional firing heads may be positioned at any location within the perforation tool 100. The additional firing heads may be positioned to drop to the bottom of the wellbore with the one or more gun assemblies 128. The additional firing heads may be any type of firing heads such as drop bar firing head or a trigger charge firing head.

Figure 4A:
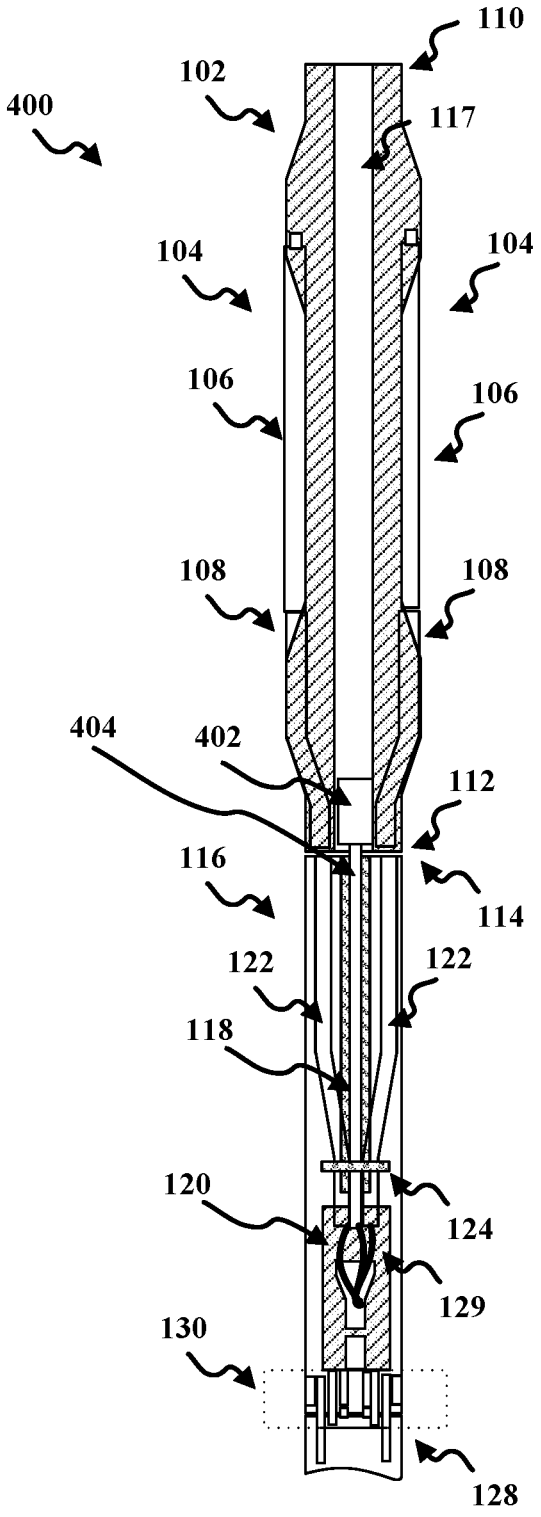
FIGS. 4A-4C illustrates an example of perforation tool, according to an embodiment.
Figure 4B:
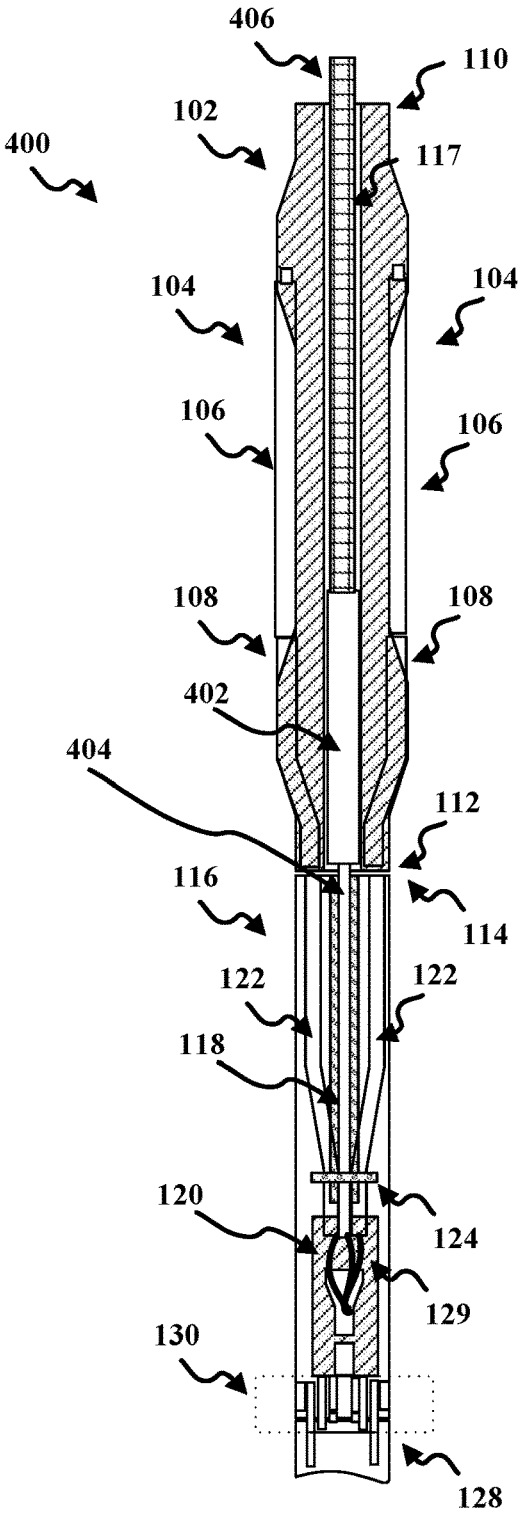
Figure 4C:
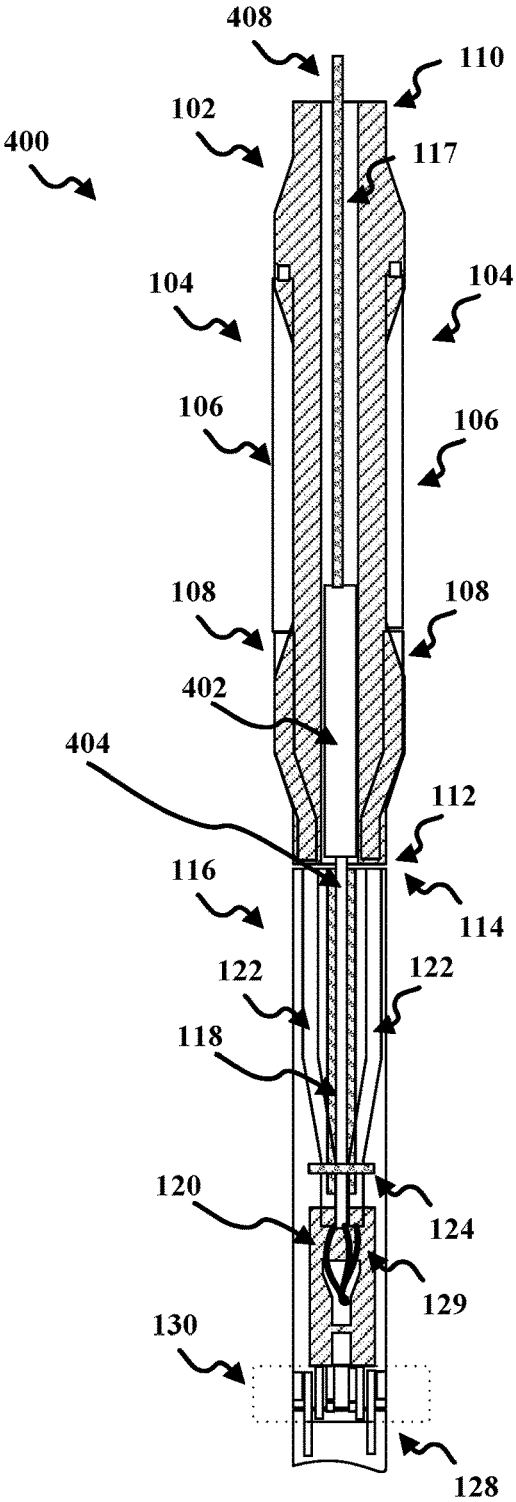

FIGS. 4A-4C illustrate examples of a perforation tool 400, according to an embodiment. The perforation tool 400 may include any of the components as described above with reference to the perforation tool 100. A description of these components may be found above with reference to FIG. 1.

As illustrated in FIG. 4A, in addition to the firing heads 106, the perforation tool 100 may include a secondary firing head 402. The secondary firing head 402 may be utilized as a backup, redundant, or supplementary firing system to the firing heads 106. The secondary firing head 402 may be positioned within the chamber 117 of the mandrel 102. For example, the secondary firing head 402 may be positioned at the lower end 112 of the mandrel 102.

The secondary firing head 402 may be coupled to a secondary detotube 404. The secondary detotube 404 may be coupled to the secondary firing head 402 at an upper end of the secondary detotube 404 and coupled to the stacking adapter 120. The secondary detotube 404 may be supported by support bar 118 and the support ring 124. The support ring 124, in combination with the support bar 118, may support and secure the lower detotubes 122. For example, the support bar 118 and the support ring 124 may be formed to provide shock protection for the upper detotubes 108, the lower detotubes 122, and the secondary detotube 404 during detonation and perforation. For example, the support ring 124 may be formed to a diameter to surround the lower detotubes 122 and the secondary detotube 404 and apply force to the lower detotubes 122 and the secondary detotube 404 to secure the lower detotubes 122 and the secondary detotube 404 against the support bar 118.

The secondary firing head 402 may be utilized to activate the one or more gun assemblies 128 in the event the firing head 106 may not fire. The secondary detotube 404 may provide a ballistic path from the secondary firing head 402 to one or for perforation guns in one or more gun assemblies 128. For example, the secondary detotube 404 may house the detonation cord 129 for igniting charges within the one or more gun assemblies 128. Once one or more detonators in the secondary firing head 402 are activated, a detonation wave may travel down the detonation cord 129 housed within the secondary detotube 404 to the stacking adapter 120. The stacking adapter 120 may provide a ballistic connection between the secondary detotube 404 and the one or more gun assemblies 128. The chamber may be formed to direct the detonation wave into the one or more gun assemblies 128 to activate the one or more perforation guns housed within. Additionally, the detonation wave may also activate the release mechanism as discussed above with reference to FIGS. 2 and 3A-3C.

The secondary firing head 402 may be attached to the support bar 118. In operation of the perforation tool 400, the secondary firing head 402 may drop to the bottom of the wellbore with the one or more gun assemblies 128 when the release mechanism activates. For example, once the release mechanism is activated, the support bar 118 may pull the secondary firing head 402 from the chamber 117 through the release housing 116.

In some embodiments, the secondary firing head 402 may include a drop-bar activated firing head. For example, the drop-bar activated firing head may include a release sleeve, which releases a firing pin of a detonator to generate the detonation wave in the detonation cord 129 in the secondary detotube 404. The release sleeve may be activated by a drop bar that may be dropped into the perforation tool 400 from above. For example, as illustrated in FIG. 4B, a tubing 406 may be attached to the secondary firing head 402. The tubing 406 may be passed up through the chamber 107 and out of the mandrel 102 at the upper end 110. The drop bar may be dropped through tubing 406 in the chamber 117 to enter the secondary firing head 402 and activate the secondary firing head 402.

In some embodiments, the secondary firing head 402 may include a trigger charge firing head. For example, the trigger charge firing head may include one or more sheer pins to release a firing pin of a detonator to generate the detonation wave in the detonation cord 129 in the secondary detotube 404. The sheer pins may be sheered by any type of process or device that applies force to sheer the sheer pins. For example, the sheer pins may be activated by increasing the pressure applied to a piston attached to the sheer pins. For example, a tubing 406, as illustrated in FIG. 4B, may be attached to the secondary firing head 402. In this example, the pressure in the tubing 406 may be increased to sheer the sheer pins and activate the detonator.

In some embodiments, for example, as illustrated in FIG. 4C, a tool or assembly 408 may attach or contact the secondary firing head 402. The tool or assembly 408 may apply physical pressure to the secondary firing head 402 to sheer the sheer pins. The tool or assembly 408 may be passed up through the chamber 107 and out of the mandrel 102 at the upper end 110. In some embodiments, the tool or assembly 408 may apply force to sheer the sheer pins and activate the detonator.

In embodiments as described above, the perforation tool 100 may be configured to allow full bore access and constructed for operation in a wellbore. In some embodiments, for example, the open inside diameter (ID) for the full bore access may not be a limited size for the entire string (e.g., ~≥2.25"). In some embodiments, for example, the maximum operating pressure may be greater than or equal to the current rating for drop tools (e.g., ~15,000 psi). In some embodiments, for example, the tensile strength may be greater than or equal to the current tensile rating for drop tools (e.g., ~270,000 lbs for 5.20 sized drop tools). In some embodiments, for example, the differential pressure rating may be greater than or equal to the current rating for drop tools (e.g., ~9,700 psi for 5.20 sized drop tools). In some embodiments, for example, the maximum working temperature may be 330° F. or greater. In some embodiments, for example, tool length may not be a limiting factor. In some embodiments, for example, the maximum outside diameter (OD) may be taken into consideration for the wellbore environment.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A perforation tool, comprising:
- a firing head;
- a gun assembly;
- a release mechanism coupled to the firing head and the gun assembly, wherein the release mechanism is configured to release the gun assembly to a bottom of a wellbore upon firing of the gun assembly and maintain the firing head on the perforation tool;
- a first detonation tube coupled to the firing head; and
- a second detonation tube coupled to the first detonation tube and the gun assembly, wherein the second detonation tube is released to the bottom of the wellbore with the gun assembly by the release mechanism and the first detonation tube remain on the perforation tool.

2. The perforation tool of claim 1, further comprising:
- a mandrel comprising a slot on an external surface of the mandrel, wherein the firing head is positioned in the slot.

3. The perforation tool of claim 1, further comprising:
- a release housing coupled to the gun assembly, wherein the release mechanism is positioned within the release housing.

4. The perforation tool of claim 1, wherein the second detonation tube is stabbed into the first detonation tube.

5. The perforation tool of claim 1, wherein the first detonation tube and the second detonation tube provides a ballistic path between the firing head and the gun assembly.

6. The perforation tool of claim 1, wherein the release mechanism comprises:
- a shoulder;
- a collet finger coupled to the gun assembly and configured to engage the shoulder;
- a sleeve comprising a release pin;
- a release piston configured to hold the release pin in a locked position against the collet finger to engage the collet finger with the shoulder; and
- a break plug coupled to the release piston and configured to secure the release piston in the locked position.

7. The perforation tool of claim 6, wherein the break plug is configured to dislodge upon firing of the gun assembly and cause the release piston to release the release pin.

8. The perforation tool of claim 1, further comprising:

an additional firing head, wherein the release mechanism is configured to release the additional firing head to the bottom of the wellbore upon firing of the gun assembly.

9. A tool for performing perforation operations in a wellbore, comprising:

a mandrel;

a firing head coupled to an external surface of the mandrel;

a release housing coupled to a lower end of the mandrel;

a release mechanism housed with the release housing;

a gun assembly coupled to the release mechanism, wherein the release mechanism is configured to release the gun assembly to a bottom of a wellbore upon firing of the gun assembly and maintain the firing head on the mandrel;

a first detonation tube coupled to the firing head; and a second detonation tube coupled to the first detonation tube and the gun assembly, wherein the second detonation tube is released to the bottom of the wellbore with the gun assembly by the release mechanism and the first detonation tube remains on the perforation tool.

10. The tool of claim 9, further comprising:

a delivery system coupled to an upper end of the mandrel, wherein the delivery system moves the mandrel within the wellbore.

11. The tool of claim 9, wherein the mandrel comprises a slot on the external surface of the mandrel, and wherein the firing head is positioned in the slot.

12. The tool of claim 9, wherein the second detonation tube is stabbed into the first detonation tube.

13. The tool of claim 9, wherein the first detonation tube and the second detonation tube provide a ballistic path between the firing head and the gun assembly.

14. The tool of claim 9, wherein the release mechanism comprises:

a shoulder;

a collet finger coupled to the gun assembly and configured to engage the shoulder;

a sleeve comprising a release pin;

a release piston configured to hold the release pin in a locked position against the collet finger to engage the collet finger with the shoulder; and a break plug coupled to the release piston and configured to secure the release piston in the locked position.

15. The tool of claim 14, wherein the break plug is configured to dislodge upon firing of the gun assembly and cause the release piston to release the release pin.

16. The tool of claim 9, further comprising:

an additional firing head, wherein the release mechanism is configured to release the additional firing head to the bottom of the wellbore upon firing of the gun assembly.

17. The tool of claim 16, further comprising:

an additional detonation tube coupled to the additional firing head and the gun assembly, wherein the additional detonation tube provides a ballistic path between the additional firing head and the gun assembly.

18. A method for performing perforation operations in a wellbore, the method comprising:

positioning a perforation tool in the wellbore, the perforation tool comprising:

a firing head, a gun assembly, a release mechanism coupled to the firing head and the gun assembly;

a first detonation tube coupled to the firing head; and a second detonation tube coupled to the first detonation tube and the gun assembly, wherein the second detonation tube is released to the bottom of the wellbore with the gun assembly by the release mechanism and the first detonation tube remains on the perforation tool; and activating the firing head to fire the gun assembly, wherein the release mechanism is configured to release the gun assembly to a bottom of the wellbore upon firing of the gun assembly and maintain the firing head on the perforation tool.

* * * * *